US006611109B2

(12) United States Patent
Zovko et al.

(10) Patent No.: US 6,611,109 B2
(45) Date of Patent: Aug. 26, 2003

(54) INFRARED EMITTING EL LAMP

(75) Inventors: Charles I. Zovko, Chandler, AZ (US); Alan C. Thomas, Gilbert, AZ (US)

(73) Assignee: Durel Corporation, Chandler, AZ (US)

( * ) Notice: Subject to any disclaimer, the term of this patent is extended or adjusted under 35 U.S.C. 154(b) by 0 days.

(21) Appl. No.: 09/974,945

(22) Filed: Oct. 9, 2001

(65) Prior Publication Data

US 2003/0071574 A1 Apr. 17, 2003

(51) Int. Cl.[7] ..... B41J 2/45
(52) U.S. Cl. ..... 315/169.3; 347/238; 347/232
(58) Field of Search ..... 315/169.3, 169.4, 315/127, 130; 347/238, 232, 240, 225, 118; 313/463, 495

(56) References Cited

U.S. PATENT DOCUMENTS

| | | | | |
|---|---|---|---|---|
| 3,052,810 A | | 9/1962 | Mash | 313/108 |
| 4,103,171 A | * | 7/1978 | Schroeder | 250/458 |
| 4,857,416 A | | 8/1989 | Kreiling et al. | 428/690 |
| 6,023,371 A | | 2/2000 | Onitsuka et al. | 359/620 |
| 6,075,322 A | | 6/2000 | Pauly | 315/127 |
| 6,133,933 A | * | 10/2000 | Paoli | 347/238 |

OTHER PUBLICATIONS

Coaton and Marsden, 1997, Arnold, Lamps and Lighting 4$^{th}$ edition, pp. 139, 284, 285.*

* cited by examiner

*Primary Examiner*—Don Wong
*Assistant Examiner*—Wilson Lee
(74) *Attorney, Agent, or Firm*—Paul F. Wille

(57) ABSTRACT

At least one layer of cascading material overlying an EL lamp converts the light emitted by the EL lamp into infrared light. The EL lamp is supported within in a container transparent to at least infrared light, along with at least one battery and an inverter to provide power for the lamp in portable applications. The lamp is rolled to form a cylinder and fits within the inside diameter of the container. The lamp can be turned on or off by means of a switch interrupting current from a battery or to the lamp.

12 Claims, 3 Drawing Sheets

INFRARED EMITTING EL LAMP

BACKGROUND OF THE INVENTION

This invention relates to low level light sources for lifting the veil of darkness in at least a portion of the light spectrum and, in particular, to an electroluminescent (EL) source of infrared radiation.

Low level light sources are used wherever there is desired sufficient light for mobility but not acuity, such as night lights and emergency lights, or where a light source is viewed directly rather than used as a source of illumination, such as marker lights. A popular source of such lighting is chemiluminescent sticks, in which two or more chemicals are mixed to produce a photochemical reaction. The container for the mixed chemicals acts as a tubular lamp. Problems with chemiluminescent sticks include low luminance, short life (defined as the time to half of initial luminance), sensitivity to jarring, disposal of materials, and the inability to turn the light off after the reaction is started. Chemiluminescent sticks typically have a life of approximately twenty minutes but will glow weakly for several hours.

An alternative to the chemiluminescent stick is a tubular electroluminescent lamp such as disclosed in U.S. Pat. No. 6,075,322 (Pauly). An EL lamp in the form of a flat sheet is rolled into a cylinder with the luminous side facing outward and stored in a transparent tube containing batteries and an inverter for driving the lamp. The EL lamp includes a dielectric layer between two conductive electrodes, one of which is transparent. The dielectric layer includes a phosphor powder or there is a separate layer of phosphor powder adjacent the dielectric layer. The phosphor powder emits light in the presence of a strong electric field, using very little current. An EL lamp requires high voltage, alternating current but consumes very little power, even including the current drawn by an inverter for driving an EL lamp.

It has long been known in the art to "cascade" phosphors, i.e. to use the light emitted by one phosphor to stimulate another phosphor or other material to emit light at a longer wavelength; e.g. see U.S. Pat. No. 3,052,810 (Mash). It is also known to doubly cascade light emitting materials. U.S. Pat. No. 6,023,371 (Onitsuka et al.) discloses an EL lamp that emits blue light coated with a layer containing fluorescent dye and fluorescent pigment. In one example, the pigment absorbs blue light and emits green light, while the dye absorbs green light and emits red light.

It is known in the art to produce infrared light from an EL lamp. In U.S. Pat. No. 4,857,416 (Kreiling et al.) a cascading fluorescent dye produces light with an infrared component. Visible light is filtered out, leaving the infrared light. The patent relies on absorbtion rather than emission, which necessarily means that relatively little infrared light is produced.

There is a need in the art for small lamps that produce infrared radiation but not visible radiation. It is often desired to mark an area or light a room without everyone being aware of the presence of a lamp. For example, law enforcement officers might want to illuminate a room with infrared light prior to entering the room, enabling the room to be scanned with a "night vision" camera or rifle scope. For temporary markers, it is critical that the marker be able to be shut off when not needed or wanted. So-called "black" lights cannot be used because such lamps emit ultraviolet radiation, which is harmful to the human eye.

In view of the foregoing, it is therefore an object of the invention to provide an EL lamp that emits sufficient infrared light to be used as a source of illumination.

Another object of the invention is to provide an EL lamp that emits infrared light in a band that matches the sensitivity of night vision devices.

A further object of the invention is to provide an infrared light source that can be turned on and off at will.

Another object of the invention is to provide an infrared light source that has a life of several hundred hours.

A further object of the invention is to provide an EL lamp that can be a flat light source or a three dimensional light source.

Another object of the invention is to provide a portable infrared light source that is insensitive to jarring.

SUMMARY OF THE INVENTION

The foregoing objects are achieved in this invention wherein at least one layer of cascading material converts the light emitted by an EL lamp into infrared light. The EL lamp is preferably supported within in a container transparent to at least infrared light. At least one battery and an inverter provide power for the lamp in portable applications and the container also encloses the battery and inverter. The lamp can be turned on or off by means of a switch interrupting current from a battery or to the lamp.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
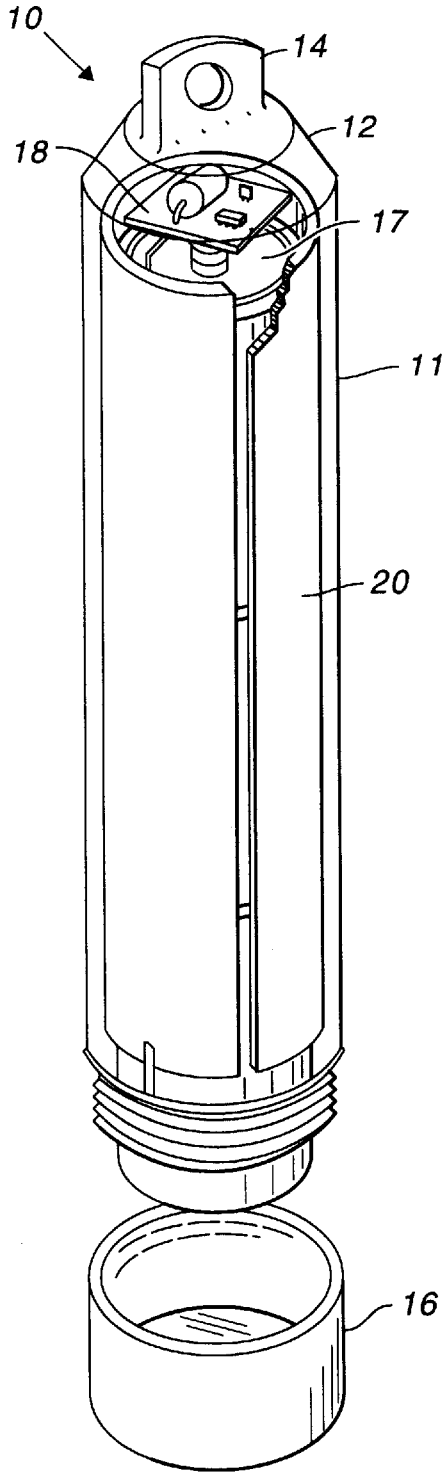
FIG. 1 is a perspective view of an infrared light source constructed in accordance with the invention.

FIG. 1 is a perspective view of an infrared light source constructed in accordance with the invention. Light source 10 includes cylindrical container 11 that is transparent to infrared radiation. Container 11 may also be transparent or translucent to visible light, as desired. One end of container 11 is closed with fitting 12 that preferably includes tab 14 having an eyelet or other mechanism for hanging or fastening source 10 to a support. Fitting 12 is preferably sealed to container 11 to form an essentially integral device. The open end of container 11 is preferably closed by cap 16 that engages threads on the open end of the container. Suitable sealing means (not shown) provides a water tight closure between cap 16 and cylinder 11.

Inside container 11, EL lamp 20 is curved to follow the curvature of the inside diameter of the container and curved such that the light emitting side is facing out. Within EL lamp 20, one or more batteries, such as battery 17, are stored. The batteries provide power for inverter 18, which drives lamp 20. The batteries are electrically coupled to inverter 18, which is electrically coupled to lamp 20. The batteries can be physically isolated from lamp 20 by suitable cushion strips (not shown) and the inverter can be glued or otherwise fastened to fitting 12 for increased ruggedness.

Inverter 18 is turned on by a switch (not shown), which can conveniently be included in cap 16. The particular construction of container 11, fitting 12, and cap 16 depends upon intended use and cost, among other factors.

Figure 2:
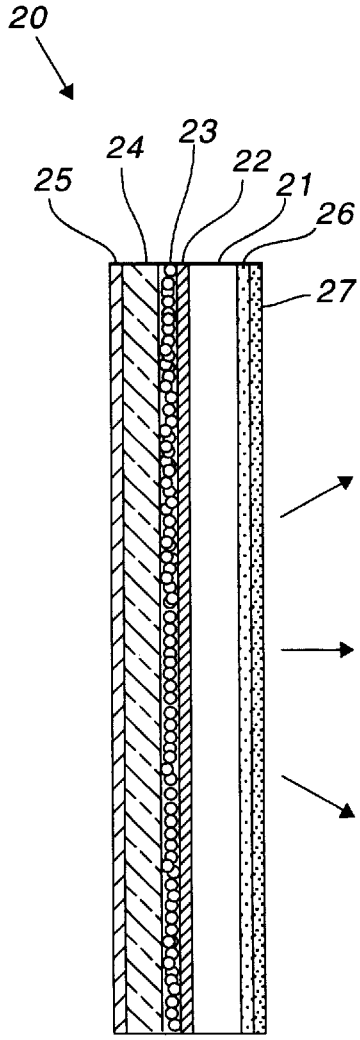
FIG. 2 is a cross-section of an EL lamp constructed in accordance with a preferred embodiment of the invention.

FIG. 2 is a cross-section of an infrared light source constructed in accordance with a preferred embodiment of the invention. The several layers shown are not in proportion or to scale. EL lamp 20 includes transparent substrate 21 of polyester or polycarbonate material. Transparent electrode 22 overlies substrate 21 and includes indium tin oxide or indium oxide. Phosphor layer 23 overlies electrode 22 and dielectric layer 24 overlies the phosphor layer. Overlying dielectric layer 24 is conductive layer 25 containing conductive particles such as silver or carbon in a resin binder. Conductive layer 25 is the rear electrode and is preferably somewhat reflective. A conductive sheet, such as aluminum foil, or a screen printed layer can be used as the rear electrode.

In one embodiment of the invention, an EL lamp constructed as described thus far was overprinted with cascading dye layers to convert light emitted by phosphor layer 23 into infrared light. If phosphor layer 23 emits orange light, a single cascading dye layer is sufficient. Preferably, phosphor layer 23 emits green light. A phosphor emitting blue-green or blue light can be used but a greater shift in wavelength is required, which is more difficult.

During operation, an alternating current is applied to electrodes 22 and 25, causing a minute current to flow between the electrodes, through the lamp, causing the phosphor in layer 23 to emit green light. The light passes through red dye layer 26, where most of the green light is converted into red light, and through infrared dye layer 27, where most of the red light is converted into infrared light.

Figure 3:
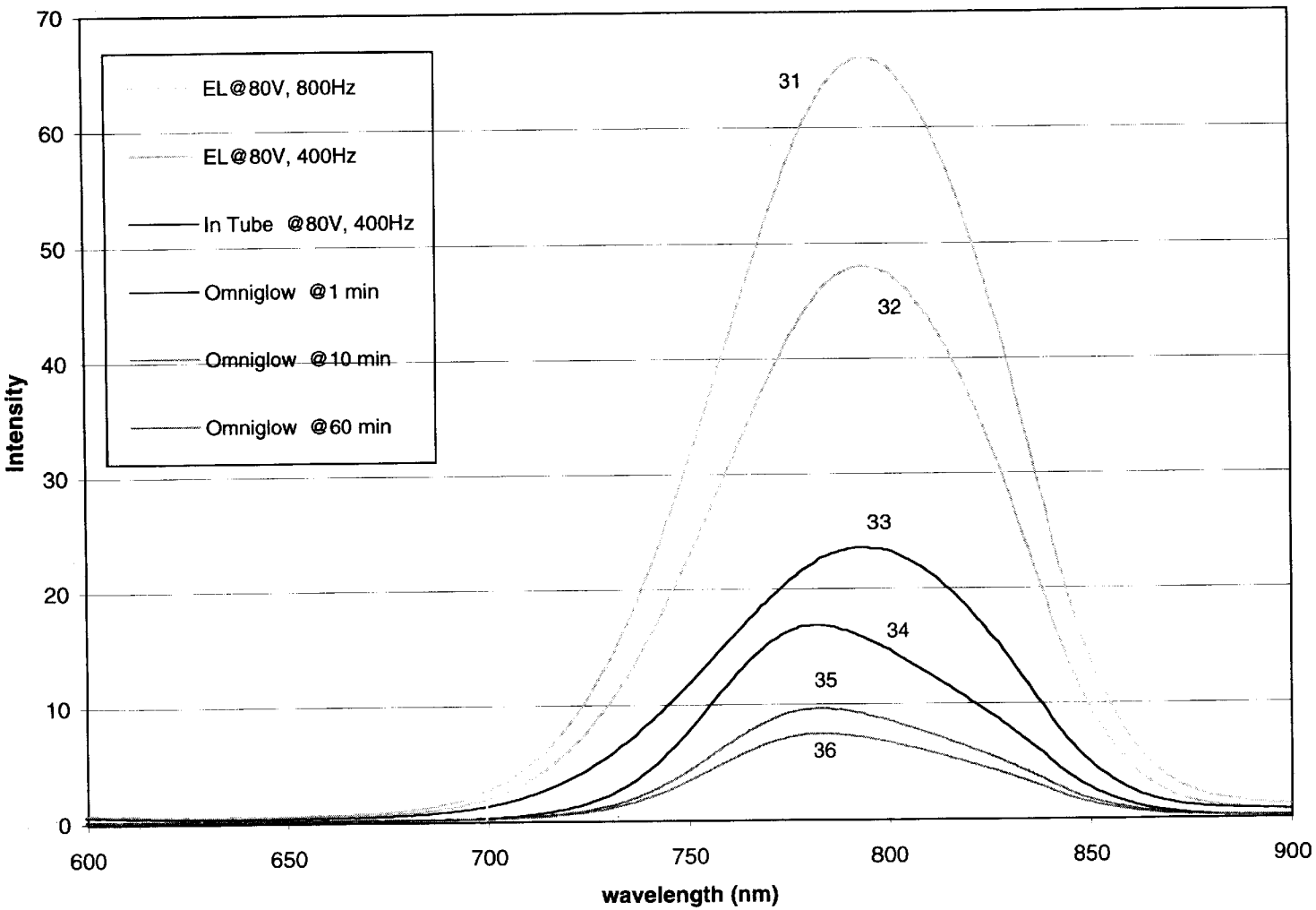
FIG. 3 is a chart comparing the light emission from a chemiluminescent stick to the light emission from a lamp constructed in accordance with the invention.

FIG. 3 is a chart comparing the light emission from a chemiluminescent stick to the light emission from a lamp constructed in accordance with the invention. As indicated by the included legend, curve 31 is the emission from an EL lamp constructed in accordance with the invention and driven at 80 volts, 800 Hz. Curve 32 is the emission from an EL lamp constructed in accordance with the invention and driven at 80 volts, 400 Hz. Curve 33 is the emission from an EL lamp constructed in accordance with the invention, rolled into a tube, and driven at 80 volts, 400 Hz. Curve 34 is the emission from an Omniglow™ light stick one minute after activation. Curve 35 is the emission from an Omniglow™ light stick ten minutes after activation. Curve 36 is the emission from an Omniglow™ light stick sixty minutes after activation.

The data for curves 31 and 32 was obtained from flat lamps. Hence, more of the light from the lamps reached the detector. Curve 33 is from a tubular light source similar to an Ominiglow™ light stick. The area of the EL lamp is about the same for the three curves but the geometry is significantly different. Thus, only curves 33 and 34 can be compared meaningfully. Curve 34 peaks around 760 nm and curve 33 peaks around 790 nm. Curve 33 is more symmetrical than curve 34. Curves 35 and 36 indicate the short life of a chemiluminescent lamp but not as well as FIG. 4.

Figure 4:
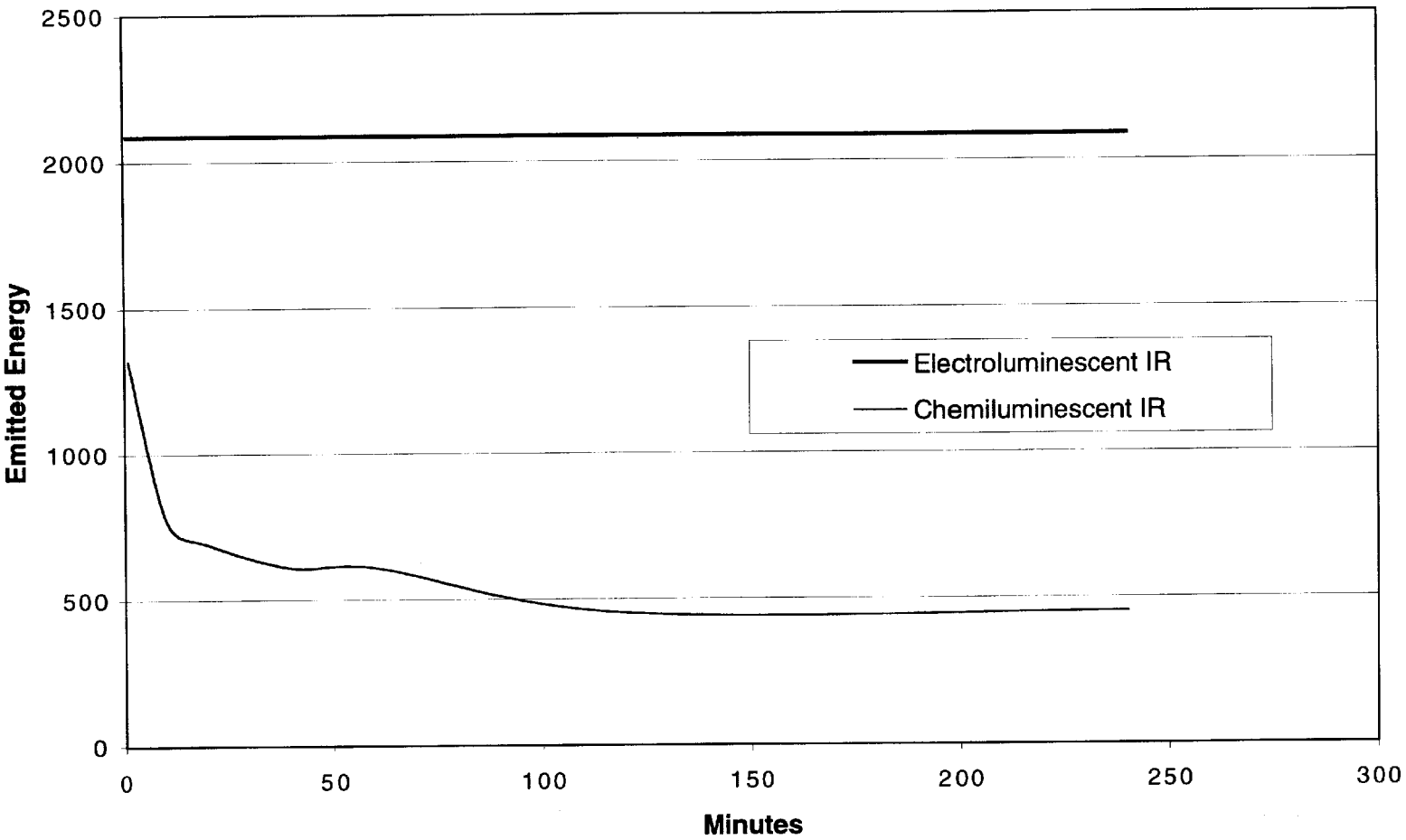
FIG. 4 is a chart comparing the life of a chemiluminescent stick with a lamp constructed in accordance with the invention.

FIG. 4 is a chart comparing the life of a chemiluminescent stick with an infrared EL lamp constructed in accordance with the invention. The time to half of initial luminance of a modern EL lamp is on the order of 1,500 hours and the cascading dyes do not affect this time. Thus, curve 41, representing an infrared EL lamp, is a straight line. As is clear from curve 42, the life of a chemiluminescent lamp is about ten minutes. However, after half brightness is reached, a chemiluminescent lamp will glow for several hours with slowly diminishing brightness, far less than the life of an EL lamp. As a practical matter, a portable light source using an infrared EL lamp will have the batteries replaced more than once before the lamp dims to half brightness.

In a preferred embodiment of the invention, the following materials and compositions were used. There are other materials and compositions that can be used to convert visible light to infrared light. Compositions are in weight percent.

| | |
|---|---|
| Red Layer: | |
| SPL 88 Mixing Clear (Nazdar) | 82.7% |
| LDS 698 Dye Solution | 16.6% |
| Care 22 (Nazdar) | 0.7% |
| wherein the Dye Solution is | |
| LDS 698 Dye Powder | 2.9% |
| DMAC (dimethylacetamide) | 97.1% |
| Infrared Layer: | |
| SPL 88 Mixing Clear (Nazdar) | 80.7% |
| Systral 9 M Dye Solution | 18.7% |
| Care 22 (Nazdar) | 0.6% |
| wherein the Dye Solution is | |
| Systral 9 M Dye Powder | 2.0% |
| DMAC | 98.0% |

Nazdar Corporation is in Shawnee, Kans. The LDS dye can be obtained from Exciton in Dayton, Ohio. The Systryl 9M dye can be obtained from Lambda Physik, Göttingen, Germany, or from Exciton as LDS821 dye. The two are chemically the same. The layers were applied to a lamp as an overprint.

The invention thus provides an EL lamp that emits sufficient infrared light to be used as a source of illumination or as a marker. The emission spectrum matches the sensitivity of night vision devices and the infrared light can be turned on and off at will. The EL infrared light source has a life of several hundred hours and can be packaged to provide a portable light source that is insensitive to jarring. The EL infrared lamp can be flat or three dimensional.

Having thus described the invention, it will be apparent to those of skill in the art that many modifications can be made with the scope of the invention. For example, cascading fluorescent materials can be used instead of dyes. The cascading material can be included within an EL lamp rather than applied to the outside. A filter blocking visible light can be added if a lamp must be invisible to the unaided human eye in total darkness. Keeping in mind that a cylinder is the surface traced by a ray following a closed figure, the light source need not have a circular cross-section but could have an elliptical cross-section, for example, to prevent rolling and to increase the amount of light emitting surface facing in a useful direction, or some other shape. Although a preferred embodiment is described as a portable light source, the invention can be constructed as a night light and plugged into household sockets or other connections to a power line. The invention can also be implemented in embodiments that use plugs for coupling to the power outlets in automobiles or other vehicles. As indicated in FIG. 3, the drive frequency affects brightness. Adjusting drive frequency and other techniques known in the art can be used to enhance brightness.

What is claimed as the invention is:

1. A light source producing substantially infrared light, said light source comprising;

an EL lamp producing light visible to the unaided human eye;

a first layer of cascading dye overlying said EL lamp for absorbing said light and emitting light at a wavelength longer than 750 nanometers.

2. The light source as set forth in claim 1 wherein said EL lamp produces light appearing to have an orange color.

3. The light source as set forth in claim 1 wherein said EL lamp produces light appearing to have a green color and said first layer of cascading dye absorbs green light to produce red light.

4. The light source as set forth in claim 3 and further including a second layer of cascading dye, wherein said second layer absorbs red light and produces infrared light.

5. The light source as set forth in claim 1 wherein said EL lamp is substantially flat.

6. The light source as set forth in claim 1 wherein said EL lamp is curved into a cylindrical surface.

7. The light source as set forth in claim 6 and further including a container at least partially enclosing said EL lamp, wherein said container is transparent to at least infrared light.

8. The light source as set forth in claim 7 wherein said container defines a cylindrical outer surface and a cylindrical inner surface.

9. A portable infrared light source comprising:

an EL lamp for producing light visible to the average unaided human eye;

a first layer of cascading dye overlying said EL lamp for absorbing said light and emitting light at a wavelength longer than 750 nanometers;

a source of direct current;

in inverter coupled to said source and to said lamp for converting said direct current into alternating current.

10. The portable infrared light source as set forth in claim 9 and further including a switch for selectively turning said lamp on or off.

11. The portable infrared light source as set forth in claim 10 and further including a container at least partially enclosing said EL lamp, wherein said container is transparent to at least infrared light.

12. The portable infrared light source as set forth in claim 11 wherein said EL lamp is curved to fit within said container.

* * * * *